US010350625B2

(12) United States Patent
Mader

(10) Patent No.: US 10,350,625 B2
(45) Date of Patent: Jul. 16, 2019

(54) METHOD AND DEVICE FOR COATING SPACERS

(71) Applicant: LISEC Austria GmbH, Seitenstetten (AT)

(72) Inventor: Leopold Mader, Neuhofen/Ybbs (AT)

(73) Assignee: LISEC AUSTRIA GMBH, Seitenstetten (AT)

( * ) Notice: Subject to any disclaimer, the term of this patent is extended or adjusted under 35 U.S.C. 154(b) by 124 days.

(21) Appl. No.: 15/109,752

(22) PCT Filed: Jan. 7, 2015

(86) PCT No.: PCT/AT2015/000001

§ 371 (c)(1),
(2) Date: Jul. 5, 2016

(87) PCT Pub. No.: WO2015/103652

PCT Pub. Date: Jul. 16, 2015

(65) Prior Publication Data

US 2016/0325299 A1 Nov. 10, 2016

(30) Foreign Application Priority Data

Jan. 8, 2014 (AT) ..... A 8/2014

(51) Int. Cl.
*B05B 13/04* (2006.01)
*B05C 9/04* (2006.01)
(Continued)

(52) U.S. Cl.
CPC ..... *B05B 13/0426* (2013.01); *B05C 5/0204* (2013.01); *B05C 9/04* (2013.01);
(Continued)

(58) Field of Classification Search
CPC ..... E06B 3/66309; E06B 3/67321; E06B 2003/6638; B05C 5/0204; B05C 9/04
See application file for complete search history.

(56) References Cited

U.S. PATENT DOCUMENTS 4,949,666 A 8/1990 Lisec
6,245,145 B1 * 6/2001 Lisec ..... E06B 3/67321 118/108

(Continued)

FOREIGN PATENT DOCUMENTS

AT 315 404 B 5/1974
AT 356 832 B 5/1980

(Continued)

OTHER PUBLICATIONS

English Translation of Korean Office Action for Application No. 10-2016-7021553, dated Apr. 24, 2018.

(Continued)

*Primary Examiner* — Xiao S Zhao
(74) *Attorney, Agent, or Firm* — Young & Thompson

(57) ABSTRACT

A nozzle pair (3, 6) is used to coat the side faces of spacers (1) for insulating glass with an adhesive material, the adhesive material being applied to the side face of the spacers (1) through the nozzles (15) of the nozzle pair. As the side faces of the spacer (1) are coated with adhesive material the nozzle pair (3, 6) is moved along the sides of the spacer (1), the relative movement between the nozzle pair (3, 6) and the spacer (1) being obtained by a movement of the spacer (1) and/or the nozzle pair (3, 6). With this way of working, there is no need to rotate the spacer (1) about an axis perpendicular to its plane and therefore the rotation can be dispensed with.

11 Claims, 4 Drawing Sheets

Figure 1:
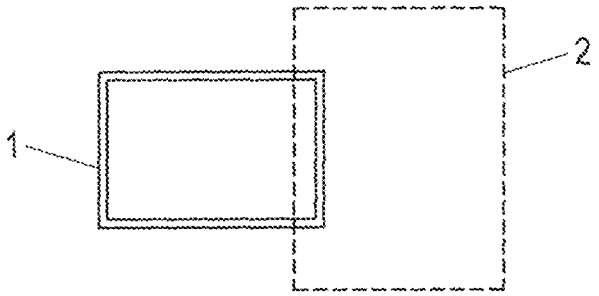
Figure 2:
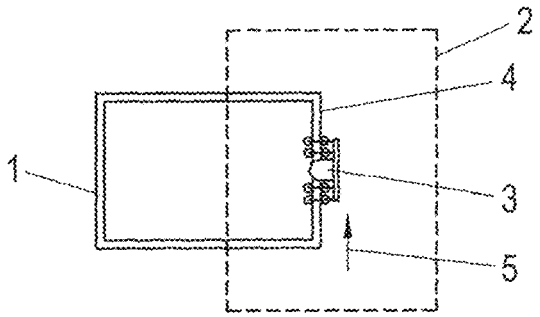
Figure 3:
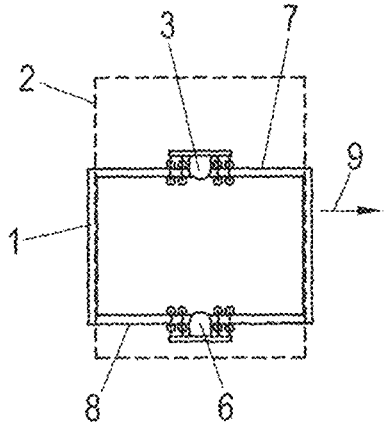
Figure 4:
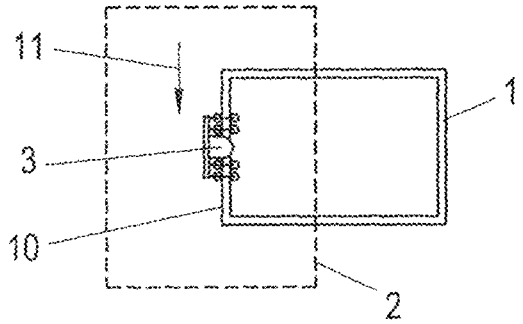

(51) Int. Cl.

| | |
|---|---|
| ***E06B 3/673*** | (2006.01) |
| ***B05C 5/02*** | (2006.01) |
| ***B05D 1/02*** | (2006.01) |
| ***E06B 3/663*** | (2006.01) |

(52) U.S. Cl.
CPC ..... *B05D 1/02* (2013.01); *E06B 3/66309* (2013.01); *E06B 3/67321* (2013.01); *B05C 5/0216* (2013.01); *E06B 2003/6638* (2013.01)

(56) References Cited

U.S. PATENT DOCUMENTS

| | | | |
|---|---|---|---|
| 2003/0205315 | A1 | 11/2003 | McGlinchy et al. |
| 2005/0167028 | A1 | 8/2005 | Reichert |

FOREIGN PATENT DOCUMENTS

| | | | |
|---|---|---|---|
| AT | 398 308 | B | 11/1994 |
| DE | 20 2011 110204 | U1 | 2/2013 |
| EP | 1 297 901 | A2 | 4/2003 |
| EP | 2 093 369 | A2 | 8/2009 |
| FR | 2 367 179 | A1 | 5/1978 |
| JP | 2001-129465 | | 5/2001 |
| KR | 20-0138683 | | 4/1999 |

OTHER PUBLICATIONS

International Search Report, dated May 13, 2015, from corresponding PCT Application.

* cited by examiner

METHOD AND DEVICE FOR COATING SPACERS

The invention relates to a method for coating spacers for insulating glass with adhesive material with the features of the introductory part of Claim 1 (AT 356 832 B).

The invention also relates to devices with which the method according to the invention can be implemented and which have the features of the introductory parts of Claims 4 and 9 (AT 356 832 B).

During the production of insulating glass, frame-like spacers, which are coated on their lateral surfaces with adhesive material (e.g., with butyl material), are used. The thus treated spacer is put on one of the glass panes of the insulating glass, and an insulating-glass blank is assembled optionally with filling the intermediate space with a gas other than air by a second glass pane being mounted on the spacer. Thus, an insulating-glass blank, comprising at least two glass panes and at least one spacer between the latter, is obtained.

Various devices are known for coating the frame-like spacers frequently composed of a metal profile strip that is curved as a single piece or is made of metal profile strips with corner angles.

A device is known from AT 315 404 B, in which device a spacer is moved by hand between a pair of nozzles that has openings facing one another, while adhesive material is applied to the lateral surfaces of the spacer. As soon as a side of the spacer formed by a profile strip has been coated with adhesive material, the spacer is rotated (for example by 90° in the case of a rectangular spacer), and then the next side is coated, until all sides of the spacer are covered with adhesive material on their lateral surfaces.

In order to automate the coating of spacers, devices have been proposed that implement the rotating (turning) of the spacer using a device (turning gripper). Reference is made to AT 356 832 B and AT 398 308 B.

US 2003/0205315 A1 relates to the coating of window frames for multi-layer-glass windows with adhesive material, via which glass panes can be fastened to the window frame. In US 2003/0205315 A1, the coating of spacers for insulating glass is also mentioned, but the latter is said to be unsuitable for the coating of window frames.

US 2003/0205315 A1 seeks to solve the problem in the case of multi-layer glass windows, which have frames made of porous material. In the method known from US 2003/0205315 A1, the window frame is oriented horizontally in two holding devices, which engage on corners of the window frame that are diagonally opposite to one another, and is attached, and a pair of nozzles is moved along the sides of the window frame that is stationary in all phases of the coating. This approach is suitable for comparatively stable window frames, but not for less dimensionally stable spacers for insulating glass, which consist of metal or plastic.

The document EP 1 297 901 A2 relates to a method for applying sticky sealant on the lateral surfaces of spacers for insulating glass. In order to keep the applied sealant from making contact with conveying and support systems, spacers are to be moved essentially freely suspended to an extrusion head, which has two nozzles, from which sealant is applied on the lateral surfaces of the spacer. To this end, the nozzles of the extrusion head are moved along the sides of the spacer. Also, the spacers are to be moved linearly and rotated in order to be able to apply sealant to all lateral surfaces of the spacer.

EP 2 093 369 A2 discloses a method and a device for filling edge joints of insulating glass blanks with sealing compound. In the case of EP 2 093 369 A2, a sealing head is provided, which head is moved relative to the insulating glass blank in order to move it along the edge joint of the insulating glass blank. In addition, the sealing head can be adjusted crosswise to the insulating glass blank so that it can always be correctly oriented relative to the edge joint. In this case, as shown in paragraph [0047] of EP 2 093 369 A2, as the first, the rear vertical edge joint relative to the conveying direction, then the horizontal upper edge joint, as the third, the vertical, front edge joint, and finally the lower horizontal edge joint are to be filled with sealing compound.

In EP 2 093 369 A2, it is also mentioned that the spacer frame that is used for the production of insulating glass in a device that is separate from the insulating glass production line is covered on its lateral surfaces with a thermoplastic sealant. EP 2 093 369 A2 does not contain any further information on how spacer frames are to be covered with the thermoplastic sealant.

The known devices for largely automatic coating of spacers for insulating glass have basically turned out to work well.

At times, however, problems arise when larger spacers or spacers with incorporated bars have to be coated.

The object of the invention is to envision a method that makes it possible to coat its lateral surfaces with adhesive material and that is gentle and that does not place any load on the spacer.

In addition, with the invention, devices are to be made available that make it possible to implement the method according to the invention.

This object is achieved with a method that has the features of Claim 1.

Insofar as the devices according to the invention are concerned, the object underlying the invention is achieved with devices that have the features of the independent Claims 4 and 9 that are directed toward the devices.

Preferred and advantageous further configurations of the method according to the invention, on the one hand, and the device according to the invention, on the other hand, are subjects of the dependent subclaims.

In the invention, rotation (turning) of the spacer, i.e., rotation around an axis that is normal to the plane of the spacer, after a side of the spacer has been coated with adhesive material, is no longer necessary, since the at least one pair of nozzles, from which adhesive material is applied to the lateral surfaces of the spacer, executes a relative motion along the sides of the spacer.

In the method according to the invention, the procedure can be performed in such a way that the spacer is oriented essentially vertically and is moved or transported lying in an essentially vertical plane.

In spacers that are oriented in such a way, the method according to the invention is executed so that (horizontal) sides of the spacer that are parallel to the conveying direction are coated while the spacer is transported linearly. The sides of the spacer that are normal to the conveying direction and oriented essentially vertically are coated, while the spacer stands still, and the at least one pair of nozzles is moved along the essentially vertical side.

When spacers for special shapes of insulating glass (non-rectangular outlines with at least one "oblique" side or outlines with at least one (curved) side that is not straight) as well as spacers for essentially square insulating glass with rounded corners (insulating glass for car windows) are to be coated with adhesive material, a linear movement of the spacer can be combined with a movement of the at least one pair of nozzles that is normal to its direction of movement.

As an alternative, consideration is given to moving the pair of nozzles along a path that is a resultant of two movement components (e.g., one horizontal and one vertical).

A device that is suitable, for example, for implementing the method according to the invention comprises a support system for the spacer, which can be formed by a roller conveyor, support cylinder conveyor, or a glide surface, optionally with an integrated conveyor belt, and a conveying system arranged on the lower end of the support system, for example in the form of rollers and/or at least one conveyor belt, on which the spacers rest. In addition, the device has at least one pair of nozzles, which is arranged in an adjustable manner in the device. The pair of nozzles can be moved upward and downward crosswise to the conveying direction and parallel to the support wall. Drives can be assigned to the pair of nozzles in order to move the drives in an essentially horizontal direction, i.e., parallel to the conveying direction. Also, drives of the pair of nozzles can interact in such a way that a horizontal movement of the pair of nozzles is combined with a vertical movement so that a curved path of movement or an "oblique" path of movement of the pair of nozzles is produced, when spacers for special shapes of insulating glass are to be coated with adhesive material.

In a modified embodiment, a device that is suitable for implementing the method according to the invention, seen from the at least one pair of nozzles that was previously described, comprises grippers that detect the spacers to be coated with adhesive material in the area of one of its sides, whereby the spacer is essentially suspended vertically downward by the grippers. In this embodiment, a support system and a conveying device on the lower edge of the support system are not needed.

In an embodiment of the device according to the invention, it can be provided that a buffer container for adhesive material is assigned to the at least one movable pair of nozzles. This buffer container for adhesive material is moved with the pair of nozzles. An amount of adhesive material that is required for coating one or more spacers is preferably introduced into the buffer container.

This embodiment has the advantage that the movable pair of nozzles no longer absolutely has to be connected to a supply line for adhesive material and drag the latter along. In this embodiment of the device according to the invention, an attempt is accordingly made to have in stock an amount of adhesive material in the buffer container that is as small as possible but nevertheless sufficiently large.

The provision of a buffer container also has the advantage that only short lines are necessary between the buffer container and the nozzles for the application of the adhesive material on the spacer, so that the adjustment of the amount of adhesive material applied to a spacer can be carried out more accurately. In this embodiment, it can be provided that the buffer container is connected to a supply container for adhesive material and if necessary, adhesive material is replenished from the supply container into the buffer container.

In the device according to the invention, the spacer, in an embodiment of the device according to the invention, is transported into the coating station by a conveying device, comprising, for example, a silicone-coated conveyor belt or conveyor rollers. Often, the net weight of the spacer is not sufficient to produce enough friction between the spacer and the conveyor belt for conveying the spacer. Therefore, within the framework of the invention, it can be provided in an embodiment that non-driven, i.e., free-wheeling, rollers are placed on the inside of the spacer that press the spacer against the conveying system and thus produce the friction that is sufficient to convey the spacer during coating.

In one embodiment of the invention, a pair of nozzles, from which adhesive material is applied to the lateral surfaces of the spacer, travels over the spacer along its entire periphery and in so doing coats it with adhesive material. In this embodiment, the spacer can stand still while it is being coated.

In this embodiment, care is taken to ensure that when coating the side of the spacer that lies on the liner conveyor, the other support and conveying means that engage on the spacer are moved away, when the pair of nozzles during implementation of the coating process is moved past it.

When the spacer in at least one direction has a dimension that is larger than the effective length of the coating station, it is possible to proceed in such a way that the spacer is set back to allow for the complete coating of a side.

In an embodiment of the invention, it can be provided that two pairs of nozzles are used when coating the spacer. In this embodiment, the procedure is such that the spacer is conveyed on the edge of the coating station. Then, using the first pair of nozzles, the one side of the spacer that is oriented crosswise to the conveying direction, e.g., the vertical, is coated with adhesive material. As soon as this is executed, the spacer is moved forward into the coating station, and in this case, its sides (e.g., upper and lower sides) of the spacer oriented parallel to the conveying direction are coated with adhesive material using the first pair of nozzles and using another, second pair of nozzles. As soon as this is executed, the second side of the spacer, oriented crosswise to the conveying direction, e.g., the vertical, is coated using the first pair of nozzles. In this embodiment, three sides of a rectangular spacer are coated using a movable pair of nozzles, and the fourth side is coated using a second pair of nozzles.

The above-described procedure can be modified by its being performed only with one pair of nozzles, whereby the spacer, after the one pair of nozzles has coated the first side, oriented crosswise to the conveying direction, e.g., the vertical, coated the (upper) horizontal side, and the other side oriented crosswise to the conveying direction, e.g., the vertical, is moved back opposite the previous conveying direction to coat the last (lower) side of the spacer.

Figure 5:
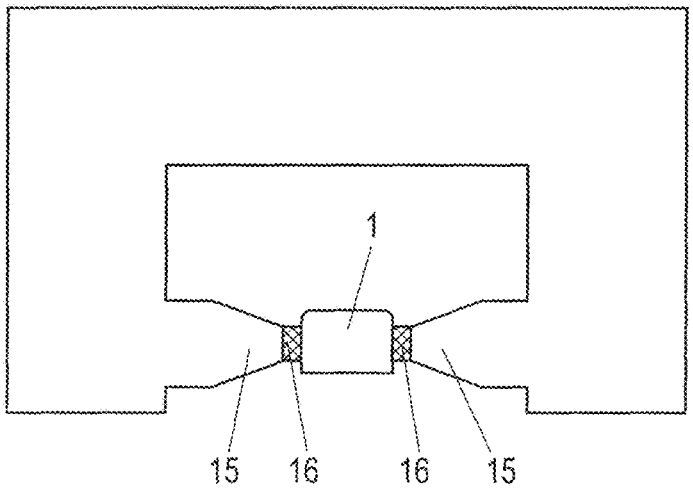
Figure 6:
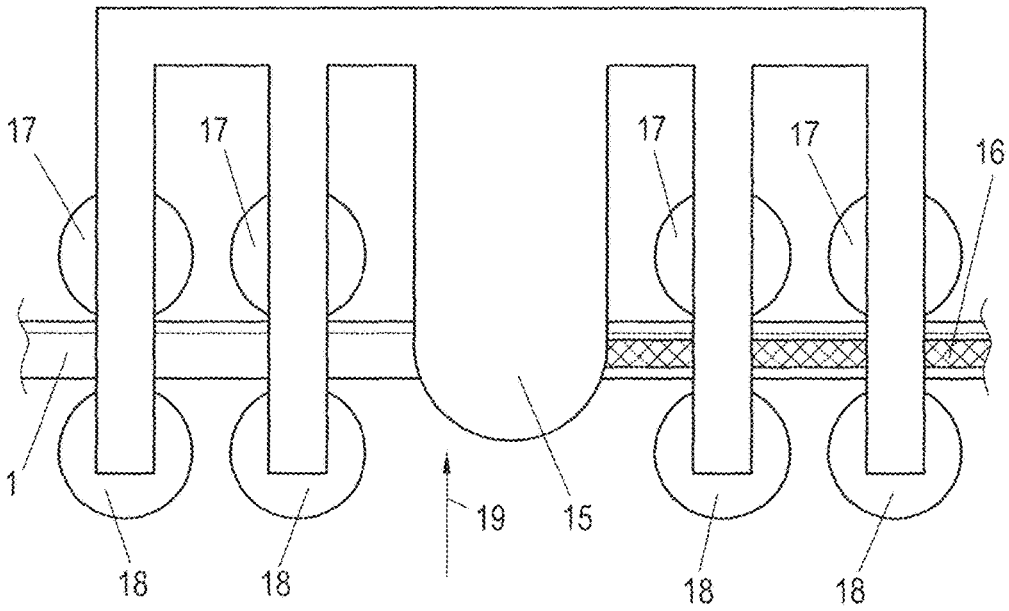
Figure 7:
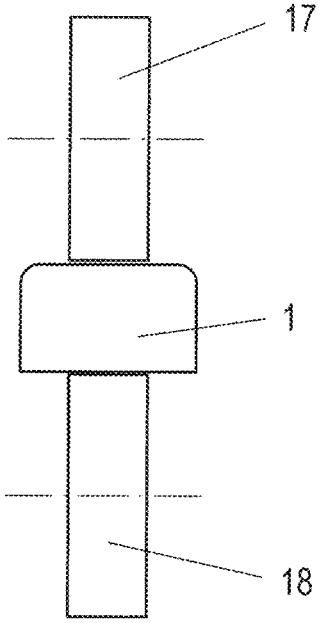
Figure 8:
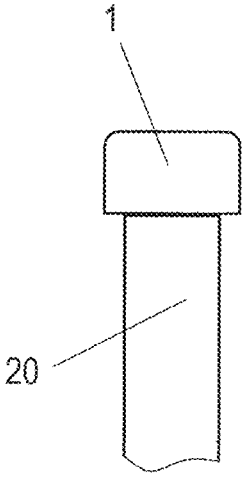
Figure 9:
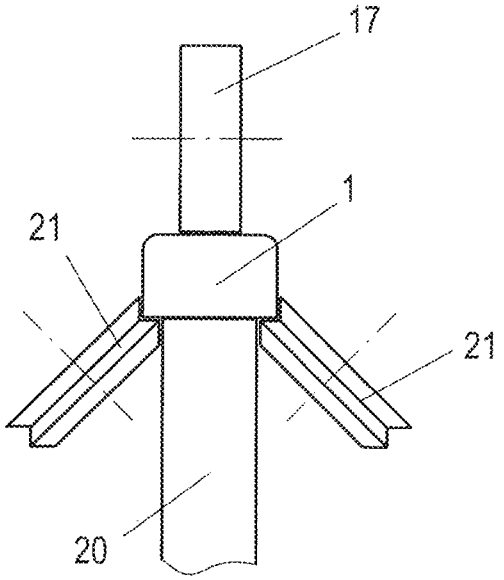
Figure 10:
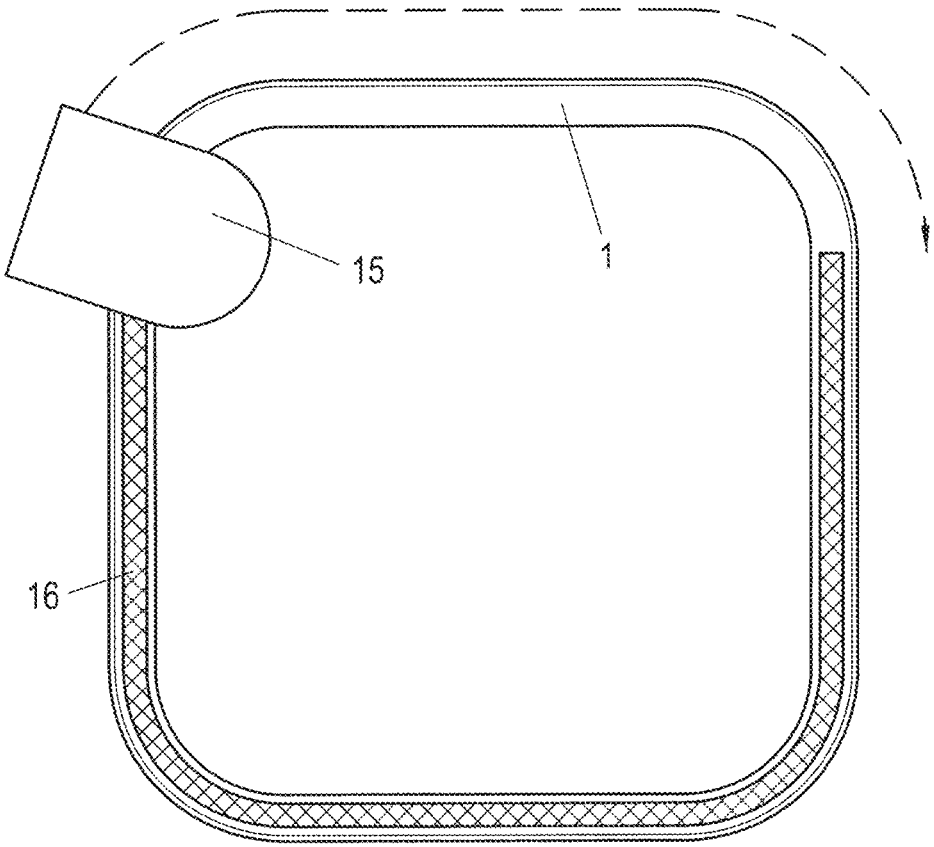
Figure 11:
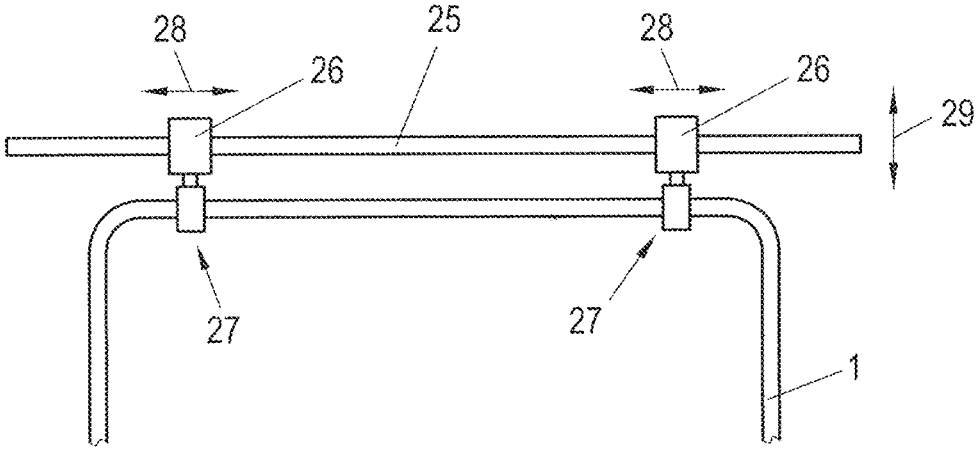

Additional details and features of the invention follow from the description below of preferred embodiments. Here:

FIGS. 1 to 4 show various stages in the coating of a spacer using two pairs of nozzles, FIG. 5 shows diagrammatically and in front view a pair of nozzles without rollers, FIG. 6 shows a side view of an embodiment for a pair of nozzles, FIG. 7 shows in section a side of a spacer with rollers assigned to it, whereby the spacer does not have any bars, FIG. 8 shows in section a side of a spacer with a bar, FIG. 9 shows the rollers assigned to the spacer of FIG. 8, FIG. 10 shows the coating of a spacer for insulating glass with rounded corners, and FIG. 11 shows diagrammatically an embodiment of a device for coating spacers.

In the procedure, shown in FIGS. 1 to 4, for coating a spacer 1 with adhesive material, a spacer 1 is conveyed into a coating station 2. As soon as the spacer 1 in the coating station 2 reaches the area of a first pair of nozzles 3, the spacer 1 is halted, and the pair of nozzles 3 is moved upward along the (front) vertical side 4 of the spacer 1 (arrow 5).

As soon as the side 4 of the spacer 1 has been coated with adhesive material, the pair of nozzles 3 is pivoted, and a second pair of nozzles 6 is brought into an active position. Then, the spacer 1 is moved linearly (arrow 9), so that relative motion is produced between the upper horizontal side 7 and the first nozzle pair 3 assigned to these sides and the lower horizontal side 8 of the spacer 1 and the second pair of nozzles 6 assigned to this side 8, so that the sides 7 and 8 are coated with adhesive material.

As the next step of the coating of the four sides of the spacer 1, the rear vertical side 10, relative to the direction of movement (arrow 9), is coated by the pair of nozzles 3 being moved along the side 10 in the direction of the arrow 11.

In the description of the embodiment shown in FIGS. 1 to 4, it is assumed that the spacer 1 in the coating station 2 is oriented essentially vertically. This is not mandatory, however, since the same sequence of movement and the same method steps can also be carried out in the case of a horizontal spacer 1.

When, in the course of the description of the embodiment shown in FIGS. 1 to 4 and in other embodiments thereof, it is said that the spacer 1 "stands still," this means that the relative motion between a pair of nozzles 3 or 6 and the spacer 1 is produced only by moving the pair of nozzles 3 or 6. This does not rule out the possibility that the spacer 1 itself may be moved (slightly) crosswise to the orientation of its side that has just been coated.

In FIG. 5, a pair of nozzles 3 or 6 with two nozzles 15, which are assigned to the side of a spacer 1 and on whose lateral surfaces layers 16 made of adhesive material are deposited, is shown in diagrammatic view. In the embodiment shown in FIG. 5, the nozzles 15 are connected, for example screwed, to a holding device, whereby their openings are directed toward the lateral surfaces of the spacer 1 so that adhesive material can be applied on them with the layers 16 of adhesive material being formed.

In the embodiment of a pair of nozzles 3 or 6 shown in FIG. 6, the rollers 17, 18 assigned to the pair of nozzles 3 or 6, which guide the pair of nozzles 3 or 6 to the spacer 1, are also depicted. In the embodiment shown in FIG. 6, consideration is given to the fact that the rollers 17, or only a single one of them, are driven. The rollers 18 arranged opposite, i.e., outside of the spacer 1, the rollers 17 arranged inside the spacer 1, which rollers rest on its inside surface, are in particular free-wheeling support rollers, which are loaded on the spacer 1 (prestressed), for example, in the direction of the arrow 19 of FIG. 6.

Instead of the rollers 17 of the embodiment of FIG. 6, conveyor belts can also be provided.

FIG. 7 shows how the rollers 17 and 18 on the side of a spacer 1 rest on their inside surfaces (rollers 17) and their outside surfaces (rollers 18).

When a spacer 1 with bars 20 (FIG. 8) is to be coated with adhesive material, a roller arrangement as is shown diagrammatically in FIG. 9 can be used. In the arrangement shown in FIG. 9, the rollers 18 are replaced by two grooved rollers 21 that, without colliding with the bars 10 of the spacer 1, can roll up against the spacer 1.

FIG. 10 shows how a pair of nozzles, represented by nozzles 15 (without rollers 17, 18 or 21), is moved when coating a spacer 1 with rounded corners in order to coat the spacer 1 with adhesive material even in the area of its rounded corners. For this purpose, the pair of nozzles is pivoted during coating of the spacer 1 in the area of its rounded corners around an axis that is oriented perpendicular to the plane of the spacer 1, while it is moved in the area of the bent corners.

In the embodiment shown in FIG. 11 of a device for the implementation of the method according to the invention for coating spacers 1 with adhesive material, at least two clamps 27 are provided on a rail 25 over slots 26, clamps that are placed to clamp the top side of a spacer 1 in order to keep the spacer 1 in a position that is essentially suspended vertically. The slots 26 can be moved along (arrow 28) the rail 25, so that horizontal movements of the spacer 1 can be implemented. In one embodiment, it can be provided that the rail 25 is adjustable up and down (arrow 29) in order to move the spacer 1 vertically. The possibility of adjusting the rail 25 in the direction of the arrow 29 allows it to match the device to the size of the spacers.

The precise guiding of the spacer 1 during application of adhesive material on its lateral surfaces is done using rollers 17, 18, 21 on the pair of nozzles 3 or 6, which can be designed, for example, as shown in FIGS. 5 and 6.

When the pair of nozzles 3 or 6 for coating the upper, horizontal side of the spacer 1 held by the clamps 27 becomes active and comes into the area of a clamp 27, the latter is detached from the spacer 1 and moves away. As soon as the pair of nozzles 3 or 6 has moved past the position at which the clamp 27 was placed on the spacer 1, the clamp 27 is closed again and placed in a clamping manner on the spacer 1.

The arrangement shown in FIG. 11 can be used not only for holding and moving the spacer 1, while the latter is covered with adhesive material, but also for bringing in and/or removing spacers 1 in the device 2 for coating spacers 1 with adhesive material.

The method according to the invention can be combined just like the device according to the invention with the filling of spacers 1 with desiccant. For example, before they enter the coating station 2, spacers 1 are filled with desiccant, and the fill opening is closed after the spacers 1 are coated with adhesive material; to do this, for example, adhesive material (butyl material) is used.

In order to hold a spacer 1, the grippers 27 shown in FIG. 11 can be replaced by pins, on which the spacer 1 is suspended. For example, such pins are provided in the area of the corners of a spacer 1 and optionally also between the corners (as support pins). Such pins are removable (e.g., retractable) from their active position that holds the spacer 1, so that the nozzles 15 can be moved during coating without being impeded by pins.

One embodiment according to FIG. 11 allows the device according to the invention to be combined in an advantageous way with upstream stations (e.g., bending a profile strip to form a spacer 1 before filling with desiccant) and downstream stations (e.g., attaching the coated spacer 1 to a glass pane). In this case, the movements in stations that are upstream and/or downstream from the device according to the invention can be implemented using slots 26, which are arranged on the (correspondingly lengthened) rail 25.

In summary, an embodiment of the invention can be described as follows:

For coating lateral surfaces of spacers 1 for insulating glass with adhesive material, a pair of nozzles 3, 6 is used, from whose nozzles 15 adhesive material is applied on the lateral surfaces of the spacer 1. In the coating of the lateral surfaces of the spacer 1 with adhesive material, the pair of nozzles 3, 6 is moved along the sides of the spacer 1. In this case, the relative motion between the pair of nozzles 3, 6 and the spacer 1 is achieved in such a way that the spacer 1 and/or the pair of nozzles 3, 6 is/are moved. With this approach, rotating the spacer 1 around an axis that is perpendicular to its plane is unnecessary and is eliminated.

The invention claimed is:

1. A method for applying an adhesive to side surfaces of a spacer (1) for insulating glass, comprising:

providing at least one nozzle pair (3, 6), each one of said nozzle pair configured to apply the adhesive to the side surfaces of the spacer; and applying, via the nozzle pair (3, 6), adhesive onto the side surfaces of the spacer (1) while a relative movement takes place between the nozzle pair (3, 6) and the spacer (1), wherein the spacer (1) is oriented in an essentially vertical plane while the adhesive material is applied onto lateral surfaces of the sides of the spacer (1), wherein, during said applying, lateral surfaces of the sides of the spacer (1) that are oriented essentially horizontally are coated by the adhesive via the nozzle pair (3, 6) by a first relative movement by way of the spacer (1) being moved linearly, wherein, during said applying, lateral surfaces of the sides of the spacer (1) that are oriented essentially vertically are coated by the adhesive via the nozzle pair (3, 6) by a second relative movement where the nozzle pair (3, 6) being moved along the side of the spacer (1), and wherein the spacer (1) is picked up on one of its sides by at least two clamps, whereby the spacer (1) is suspended essentially vertically downward from the clamps, and the nozzle pair (3, 6) is caused to run on the spacer (1) by conveying means that move the nozzle pair (3, 6) for applying the adhesive to the side surfaces.

2. The method according to claim 1, wherein, during said applying, lateral surfaces of the sides of the spacer (1) that are neither vertical nor horizontal are coated by the adhesive via the nozzle pair (3, 6) by a third relative movement where the spacer (1) stands still and the nozzle pair (3, 6) is moved in a direction correspondent to the lateral surfaces that are neither vertical nor horizontal.

3. The method according to claim 1 wherein, during said applying, lateral surfaces of the sides of the spacer (1) that include curved sections are coated by the adhesive via the nozzle pair (3, 6) by a fourth relative movement where the nozzle pair (3, 6) pivot in the area of said curved sections.

4. The method according to claim 1, wherein the conveying means that move the nozzle pair (3, 6) are rollers, at least one of which are driven.

5. The method according to claim 1, wherein the conveying means that move the nozzle pair (3, 6) are conveyor belts.

6. An apparatus for carrying out the method according to claim 1, comprising:

at least one pair of nozzles (3, 6), said pair of nozzles (3, 6) including a drive for adjusting the pair of nozzles (3, 6) in a plane that is parallel to the plane of the spacer; and at least two clamps (27) configured to hold the spacer (1) during the coating and which are linearly adjustable for moving the spacer (1).

7. The apparatus according to claim 6, wherein the clamps (27) are provided on a guide rail (25) and are adjustable along a length of said guide rail (25).

8. The apparatus according to claim 7, wherein the guide rail (25) transversely to its longitudinal extent in the plane of the spacer (1) is adjustable.

9. The apparatus according to claim 6, wherein the nozzles (15) of the nozzle pair (3, 6) is associated with a moving storage container for storing adhesive therein.

10. The apparatus according to claim 6, wherein the at least one pair of nozzles (3, 6) includes rollers, at least one of said rollers being driven.

11. The apparatus according to claim 6, wherein the at least one pair of nozzles (3, 6) includes a conveyor belt.

* * * * *